US008801373B2

(12) United States Patent
Kojima et al.

(10) Patent No.: US 8,801,373 B2
(45) Date of Patent: Aug. 12, 2014

(54) HIGH-RELIABILITY TURBINE METAL SEALING MATERIAL

(75) Inventors: Yoshitaka Kojima, Hitachi (JP); Hideyuki Arikawa, Mito (JP); Akira Mebata, Kitaibaraki (JP); Hiroyuki Doi, Tokai (JP); Hajime Toriya, Hitachi (JP); Kenjiro Narita, Hitachinaka (JP)

(73) Assignee: Hitachi Ltd., Tokyo (JP)

( * ) Notice: Subject to any disclaimer, the term of this patent is extended or adjusted under 35 U.S.C. 154(b) by 1053 days.

(21) Appl. No.: 12/825,525

(22) Filed: Jun. 29, 2010

(65) Prior Publication Data

US 2011/0014035 A1 Jan. 20, 2011

(30) Foreign Application Priority Data

Jun. 29, 2009 (JP) ..... 2009-154205

(51) Int. Cl.
*F04D 29/08* (2006.01)
*F01D 11/12* (2006.01)

(52) U.S. Cl.
USPC ..... 415/174.4; 416/241 R; 277/415; 428/313.9; 428/316.6; 428/318.8; 428/310.5; 427/447; 427/556

(58) Field of Classification Search
USPC ..... 415/170.1–174.5; 416/241 R, 241 A, 416/230; 428/615, 678, 304.4, 316.6, 613; 277/652–654, 644, 411, 412, 414, 415; 427/451, 453–456, 528, 556, 576, 584
See application file for complete search history.

(56) References Cited

U.S. PATENT DOCUMENTS

| | | | | |
|---|---|---|---|---|
| 3,825,364 | A | 7/1974 | Halila et al. | |
| 3,879,831 | A * | 4/1975 | Rigney et al. | 415/173.4 |
| 4,336,276 | A * | 6/1982 | Bill et al. | 427/447 |
| 5,024,884 | A | 6/1991 | Otfinoski | |
| 5,034,284 | A * | 7/1991 | Bornstein et al. | 428/680 |
| 5,780,116 | A | 7/1998 | Sileo | |

(Continued)

FOREIGN PATENT DOCUMENTS

| | | |
|---|---|---|
| EP | 1 734 145 A1 | 12/2006 |
| JP | 61-149506 | 7/1986 |
| JP | 61-171969 | 8/1986 |
| JP | 9-067662 | 3/1997 |

(Continued)

OTHER PUBLICATIONS

EP Search Report of Appln. 10006717.2 dated Feb. 11, 2011.

(Continued)

*Primary Examiner* — Ned Landrum
*Assistant Examiner* — Ryan Ellis
(74) *Attorney, Agent, or Firm* — Antonelli, Terry, Stout & Kraus, LLP.

(57) ABSTRACT

A metal sealing material used in a sealing device which can reduce a gap between a stator and a rotor of a turbine. The metal sealing material used in a sealing device for a stator and a rotor of a turbine includes a surface layer and a lower layer composed of a porous metal layer, wherein the porosity of the surface layer is smaller than the porosity of the lower layer; the porosity of the surface layer is 60 to 65% and the porosity of the lower layer is 67 to 75% or less; and the porous metal layer has a thickness of 0.3 to 3.0 mm and may include, as a main component, an MCrAlY alloy where M is either one of Ni and Co or both thereof, and h-BN as a solid lubricant.

4 Claims, 7 Drawing Sheets

(56) References Cited

U.S. PATENT DOCUMENTS

| | | | | |
|---|---|---|---|---|
| 6,057,047 | A | 5/2000 | Maloney | |
| 7,287,956 | B2 * | 10/2007 | Bracken et al. | 415/173.3 |
| 2003/0207079 | A1 * | 11/2003 | Subramanian | 428/136 |
| 2004/0126225 | A1 | 7/2004 | Ghasripoor et al. | |
| 2005/0260434 | A1 | 11/2005 | Nelson et al. | |
| 2008/0019821 | A1 | 1/2008 | Narita et al. | |
| 2008/0102220 | A1 | 5/2008 | Haynes | |
| 2008/0124548 | A1 | 5/2008 | Sporer et al. | |
| 2009/0053069 | A1 | 2/2009 | Barnikel | |
| 2009/0110560 | A1 | 4/2009 | Bayer | |
| 2009/0142187 | A1 | 6/2009 | Narita et al. | |

FOREIGN PATENT DOCUMENTS

| | | | |
|---|---|---|---|
| JP | 11-264059 | | 9/1999 |
| JP | 2005-330586 | | 12/2005 |
| JP | 2007-327139 | | 12/2007 |
| JP | 2008-025429 | | 2/2008 |
| JP | 2008-111191 | | 5/2008 |
| JP | 2009-138566 | | 6/2009 |
| WO | WO 2005/014979 | A1 | 2/2005 |

OTHER PUBLICATIONS

EP Search Report of Appln. No. 12158240.7 dated Feb. 11, 2013 in English.

* cited by examiner

HIGH-RELIABILITY TURBINE METAL SEALING MATERIAL

BACKGROUND OF THE INVENTION

1. Field of the Invention

The present invention relates to high-reliability metal sealing materials used in sealing devices of turbines, in particular, steam turbines of combined cycle power plants, conventional thermal power plants, atomic power plants and the like.

2. Background Art

The work efficiency of a steam turbine used in a power generation plant is affected by an amount of a fluid that rotates a turbine blade to generate a motive force (rotating torque); accordingly, performance of a sealing technology that reduces an amount of a fluid leaking from a gap between a stator and a rotor of a turbine determines performance of the turbine. The sealing technology is expected to have a function (abradability) by which even in the worst case where the stator and the rotor come into contact, without damaging both the stator and rotor, only a sealing material is scrubbed and reduced in thickness. Owing to the abradability of the sealing material disposed between the stator and rotor, a gap between the stator and rotor can be reduced to zero without limit, and thereby an amount of a fluid leaking from the gap can be neared zero; accordingly, the work efficiency of the turbine can be largely improved.

As to the sealing technology, in particular, a porous coating layer, for example, JP Published Patent Application No. 61-171969A (1986) discloses a sealing layer made of porous metal (density ratio: 26 to 40%, 60 to 74% in terms of porosity), and, further, discloses to dispose, on the outermost surface portion thereof, a surface layer containing ceramic microparticles to impart corrosion resistance to a working fluid. An object thereof is to prevent "self-erosion" of a sealing material owing to particle detachment from a porous metal sealing material and it is disclosed that the outermost layer containing ceramic microparticles formed on a surface layer exerts its effect of preventing particles from detaching. A target is a turbomachine, but there is no description meaning a steam turbine environment.

In JP Published Patent Application No. 2005-330586A (2005), a metal bond layer of thermal barrier coating (TBC) for gas turbines is formed into a two layer structure having a lower layer and an upper layer, and the upper layer is formed porous (porosity: 3 to 4%) and integrated with a ceramic top layer to improve the heat endurance of the TBC. In this example, in order to alleviate thermal stress, the porosities are gradually varied through the lower layer and upper layer of the metal bond layer and more up to the ceramic top layer. However, there is such a large difference as about 1:10 between thermal expansion coefficients of the ceramic layer and the metal bond layer; accordingly, the thermal stress tends to be increased. JP Published Patent Application No. 2005-330586A (2005) intends to relax thermal stress of a metal bond layer of a thermal barrier coating (TBC) for gas turbines, but not of a metal sealing material of the present invention.

JP Published Patent Application No. 2007-327139A (2007) discloses, as to a ceramic seal, a high temperature sealing material where a dysprosia ($Dy_2O_3$)-stabilized zirconia ($ZrO_2$) material (DySZ) that is a top ceramic layer is made porous so as to have the porosity of 15 to 45% and integrated with a dense undercoat metal layer to form a two layer structure and that can be used up to 1200° C. JP Published Patent Application No. 2007-327139A (2007) intends to provide a ceramic sealing material made of a ceramic up to 1200° C., but not of a metal sealing material of the present invention.

JP Published Patent Application No. 09-67662A (1997) discloses, as to a ceramic coating member, a two-layer structure where a top ceramic layer is densified so that the porosity may be 0 to 5% and an underlayer ceramic layer is made porous so as to have the porosity of 20 to 30% to alleviate thermal stress. Similarly to JP Published Patent Application No. 2005-330586 (2005), there is a large difference of about 1:10 between thermal expansion coefficients of the ceramic layer and the metal bond layer; accordingly, a ceramic layer is formed into two layers to alleviate thermal stress. JP Published Patent Application No. 09-67662A (1997) discloses ceramic layers different in porosity to relax thermal stress of a ceramic coating member, but not of a metal sealing material of the present invention.

Concerning the sealing technology, in particular, a porous coating layer, no patent literature has been found concerning a metal sealing material under a steam turbine environment.

SUMMARY OF THE INVENTION

An object of the present invention is to provide a sealing material for a sealing device excellent in abradability, steam resistance (for example, steam resistance heat cycle property assuming stop and start) and long-term durability under a steam temperature, which are an original object of a metal sealing material.

A turbine metal sealing material of the present invention is a metal sealing material used in a sealing device that reduces a fluid leaking from a gap between a stator and a rotor of a turbine, wherein the metal sealing material has a porous metal layer, the porous metal layer includes a surface layer directly coming into contact with a working fluid and a lower layer thereunder, and the porosity of the surface layer is lower than the porosity of the lower layer.

According to the present invention, a sealing material for a sealing device excellent in abradability, steam resistance (for example, steam resistance heat cycle property assuming stop and start) and long-term durability under a steam temperature, which are an original object of a metal sealing material, can be provided.

BRIEF DESCRIPTION OF THE DRAWINGS

FIGS. 1A AND 1B show embodiments of the present invention, wherein FIG. 1A shows an example where a sealing material of the present invention is disposed on a rotor side (a rotor side), and FIG. 1B shows an example where the sealing material is disposed on a stator side (a casing side).

DESCRIPTION OF SYMBOLS

1 . . . Rotor, 2 . . . Casing, 3 . . . Fin, 4 . . . Stator blade, 5 . . . Sealing material, 6 . . . Bar material (Fixing piece), 7 . . . Ring material (Movable piece), 8 . . . Heater, 11 . . . Base material, 12 . . . Underlayer, 16 . . . High pressure rotor blade, 17 . . . Medium pressure rotor blade, 18 . . . High pressure inner wheel chamber, 19 . . . High pressure outer wheel chamber, 20 . . . Medium pressure inner wheel chamber, 21 . . . Medium pressure inner wheel chamber, 22 . . . Medium pressure outer wheel chamber, 25 . . . Flange, Elbow, 28 . . . Main steam inlet, 33 . . . High to medium pressure rotor shaft, 38 . . . Nozzle box, 43 . . . Bearing, 51 . . . Top layer portion of a sealing material of the present invention, 52 . . . Lower layer of a sealing material of the present invention, 61 . . . Labyrinth sealing device.

DETAILED DESCRIPTION OF THE PREFERRED EMBODIMENTS

Figure 1A:
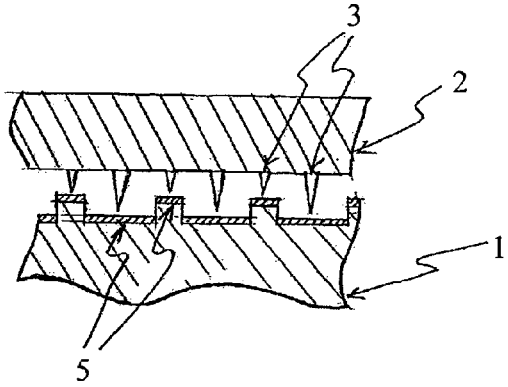
Figure 1B:
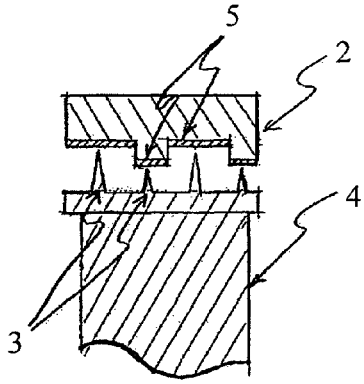

An example of an embodiment of the present invention is shown in FIG. 1. In FIG. 1A, an example where a sealing material 5 involving the present invention is disposed to a rotor 1 that is a rotating portion coping with fins 3 disposed to a casing 2 is shown. In FIG. 1B, an example where a sealing material 5 involving the present invention is disposed to a casing 2 coping with fins disposed to a tip end of a rotor blade 4 is shown.

The sealing material is a porous metal layer and the porosity thereof is a material parameter. In a porous metal layer, an MCrAlY alloy as a main component and hexagonal boron nitride (h-BN) can be used. The MCrAlY alloy contains 15 to 30% of Cr, 6 to 15% of Al, and 0.3 to 1.0% of Y, the balance being composed of either one of Ni and Co or both thereof The thermal expansion coefficient of a porous metal layer is $13\times10^{-6}$ and is not much different from the thermal expansion coefficient (13 to $15\times10^{-6}$) of ferrite steel constituting steam turbine rotors, blades and casings; accordingly, there is no need to consider relaxation of thermal stress. Furthermore, in a steam turbine that is a target of the present invention, the maximum temperature is 700° C.; accordingly, no ceramic material is required, and the metal sealing material can secure sufficient heat resistance.

In the present invention, requirements necessary as a sealing material for steam turbines, that is, (1) abradability in the temperature range up to a steam temperature of a steam turbine, (2) steam resistance heat cycle of start and stop (after moisture impregnation at the time of stop, repetition of heating to a steam temperature and cooling therefrom), and (3) endurance to a long term exposure at a steam temperature were investigated, and porous metal layers satisfying all of the requirements were found.

Figure 2:
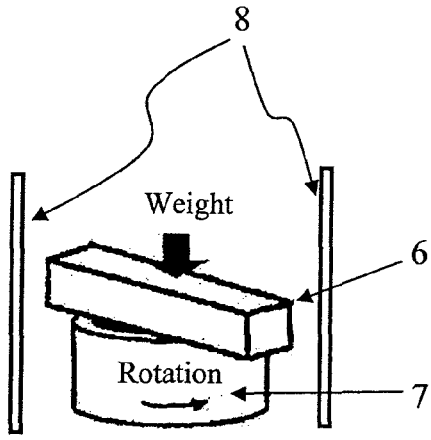
FIG. 2 shows an outline drawing of a high-temperature wear test that is used to evaluate the abradability at temperatures up to a steam temperature of a steam turbine.

FIG. 2 shows an outline drawing of a high-temperature wear test used to evaluate abradability at temperatures up to a steam temperature of a steam turbine. A porous metal layer was disposed on a surface of a bar material 6 coping with a ring material 7 on a rotation side and heated to a predetermined temperature by a heater 8, and a test was started. The number of rotation of the ring material 7 (outer diameter ϕ: 25 mm) was set at 6000 rpm and, with an indentation weight of the bar material 6 (10×10×40 mm) gradually increasing, the bar material 6 was indented up to 80% of a thickness of the porous metal layer. As the results of the tests, in the case where the abradability is deficient, the ring material and the porous metal layer caused sticking, and in the case where the abradability is excellent, the sticking of the ring material and the porous metal layer was not at all found and the porous metal layer was ground by the ring material.

Figure 3:
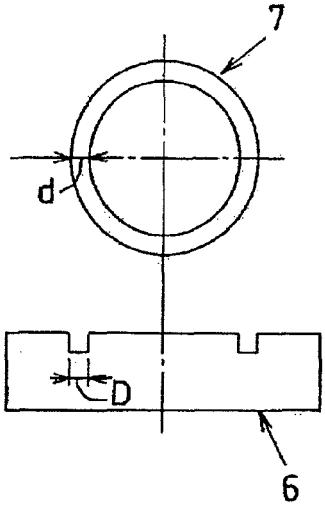
FIG. 3 shows a plate thickness (d) of a ring material 7 and a groove width (D) of a groove formed in a porous metal layer.

FIG. 3 shows a plate thickness (d) of the ring material 7 and a groove width (D) of a groove formed by indenting the ring material 7 in the porous metal layer disposed on a surface of the bar material 6. As an abradable property showing a degree of the abradability, a ratio (d/D) of a plate thickness (d) of the ring to a groove width (D) formed on the porous metal layer was used.

When the abradability is excellent, the abradable property (d/D) shows a value close to 1.0. The tests were conducted at the respective temperatures of room temperature (RT), 400, 500, 600 and 700° C.

TABLE 1

| Abradable Property | | | | | |
|---|---|---|---|---|---|
| | Temperature (° C.) | | | | |
| Porosity (%) | RT | 400 | 500 | 600 | 700 |
| 60 | 0.5[1)] | 0.5[1)] | 0.5[1)] | 0.5[1)] | 0.5[1)] |
| 65 | 0.6[1)] | 0.6[1)] | 0.6[1)] | 0.6[1)] | 0.6[1)] |
| 67 | 0.8 | 0.8 | 0.8 | 0.8 | 0.8 |
| 70 | 0.9 | 0.9 | 0.9 | 0.9 | 0.9 |
| 75 | 0.9 | 0.9 | 0.9 | 0.9 | 0.9 |

[1)]partial sticking

In Table 1, data of the test results are shown. In porous metal layers having a porosity of 60 or 65%, at all temperatures, partial sticking was found between a ring material and the porous metal layer, and d/D was 0.5 and 0.6. On the other hand, in porous metal layers having a porosity of 67, 70 or 75%, at all temperatures, partial sticking was not found between a ring material and the porous metal layer, and d/D was 0.8 or more and the abradability was good.

Figure 4:
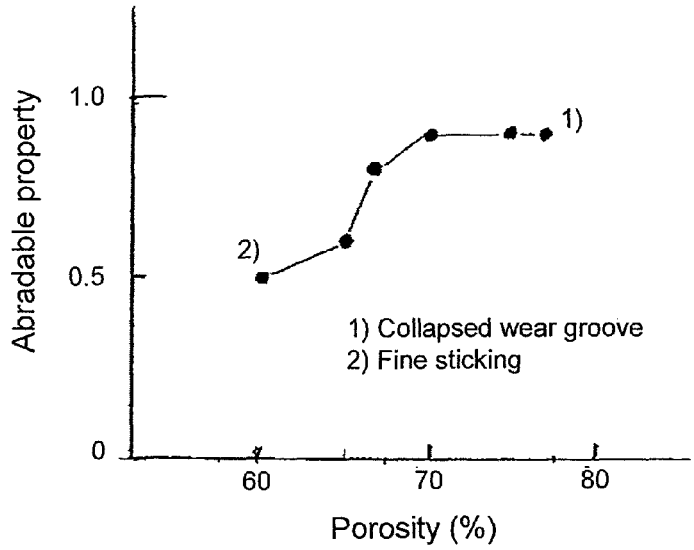
FIG. 4 shows results of tests conducted by further expanding a range of the porosity of the porous metal layer at a temperature of 600° C.

FIG. 4 shows results when tests were conducted by further expanding a range of the porosity of the porous metal layers at a temperature of 600° C. At the porosity of 55%, remarkable sticking of the porous metal layer to the ring material is caused and the porous metal layer is not at all ground. At the porosity of 77%, a groove wall of the porous metal layer ground by the ring material falls and thereby the groove is collapsed. Results like this showing similar tendency were obtained also in tests at other temperatures.

As the results of the above-mentioned tests, it was found that in a range from room temperature to 700° C., which is assumed to be a use condition of a steam turbine, a range where the porosity of the porous metal layer is 60 to 75% is excellent. It was found that in the range, the abradability (d/D) is 0.8 to 0.9 close to 1, that, is very good.

In the next place, an evaluation of (2) the steam resistance heat cycle of the start and stop (repetition of heating up to a steam temperature and cooling therefrom after moisture impregnation at the time of stop) was conducted. The heat cycle where a porous metal layer is heated up to 700° C. from a state immersed in water, held there for about 10 min, and put again in water was conducted. The number of repetition was 500 times. As the result thereof, in the case where the porosities of the porous metal layers are 55, 60 and 65%, no abnormality was found of the porous metal layers. However, in the case where the porosities are 70 and 75%, after repetition of 100 times, a surface portion was locally peeled (pitching damage), and as the number of repetitions increases, the number of occurrences and damage depth increased. In the case of 77%, the degree of damage further worsened and a part of the porous metal layers was completely peeled.

In an actual turbine, while, when a steam turbine comes to stop, a dew temperature of steam goes down to generate moisture and a sealing portion is partially immersed in water, when the steam turbine is started, a temperature goes up with the moisture contained in the sealing portion, and, in the porous metal layer high in porosity, since a bonding force between individual particles is small, damaging and peeling proceed locally from a surface portion. In the actual turbine, a steam flow rate is considered to synergetically work so that local peeling (pitching damage) of a surface portion may be a starting point of the peeling; accordingly, the porosity is desirable to be inhibited from becoming too high. Accordingly, on a surface portion that comes into contact with steam, it is desirable to dispose a porous metal layer having the porosity of 60 to 65%.

Then, (3) the endurance against a long term exposure at a steam temperature was evaluated by conducting a long term exposure test under conditions of normal pressure and 700° C. by assuming a steam temperature (700° C.) of a steam turbine. Each of porous metal layers having the porosities of 55, 60, 65, 67, 70, 75 and 77% was subjected to a test for 1000 hr. As the results thereof, all porous metal layers were free from damage such as peeling and healthy.

Figure 5:
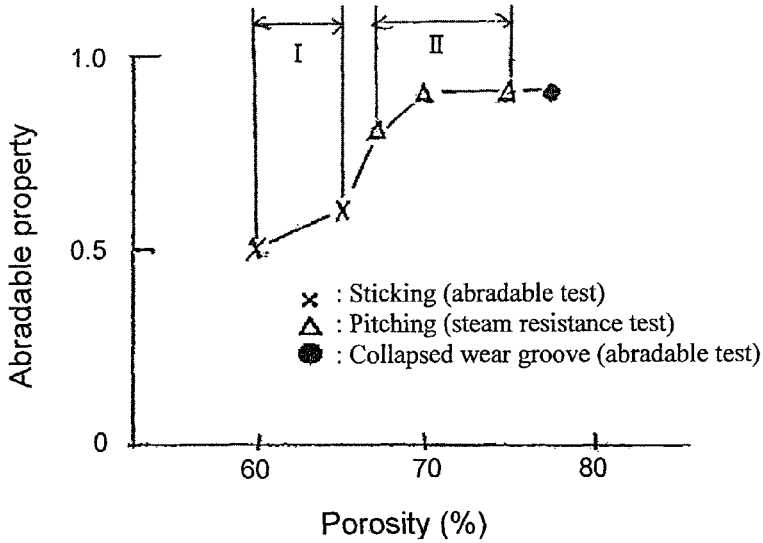
FIG. 5 together shows results of tests evaluating characteristics.

In FIG. 5, experimental results of the (1) to (3) are shown all together. In FIG. 5, the porous metal layers having the porosities of 60 to 65% show characteristics where the abradable property of (1) is about 0.6. However, in a single layer structure of the porous metal layer in the range (a range indicated by a mark I), when a rotor and a stator come into contact, sticking is caused and thereby sufficient sealing characteristics cannot be obtained. Furthermore, the porous metal layers having the porosities of 67 to 75% exhibit characteristics where the abradable property of (1) is 0.8 to 0.9. However, in a single layer structure of the porous metal layers in the range (a range indicated by a mark II), the steam resistance heat cycle characteristics of (2) are poor; accordingly, the local peeling (pitching damage) is caused on a surface portion during use, the surface irregularity becomes larger to result in lowering the sealing characteristics.

In this connection, a high endurance sealing material involving the present invention is formed into a two layer structure made of a coating layer and a lower layer, wherein the coating layer uses a porous metal layer (in the range shown by a mark I) excellent in the (2) steam resistance heat cycle characteristics, and the lower layer that is disposed thereunder and not exposed directly to steam uses a porous metal layer (in the range shown by a mark II) that is poor in the (2) steam resistance heat cycle characteristics but has excellent characteristics of 0.8 to 0.9 of abradable property. Both of the coating layer and lower layer have sufficient characteristics of (3) the endurance against long term exposure at a steam temperature.

In the high endurance sealing material of the present invention, a surface layer portion effectively works to (2) the steam resistance heat cycle characteristics, and, in the case where the rotor and stator come into contact, although an initial contact occurs on a surface layer portion, when the contact portion in due time reaches a lower layer, the abradable property shows excellent characteristics of 0.8 to 0.9; accordingly, both of a portion that comes into contact and a portion that does not come into contact show excellent sealing characteristics as a sealing material over a long term.

Figure 6A:
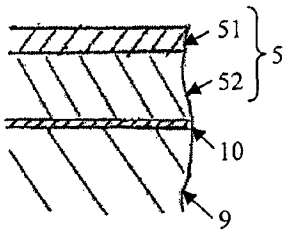
FIGS. 6A, 6B, 6C and 6D show schematic sectional views of a sealing material of the present invention.
Figure 6B:
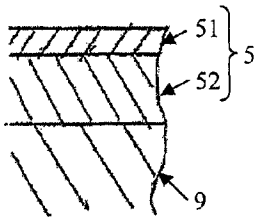
Figure 6C:
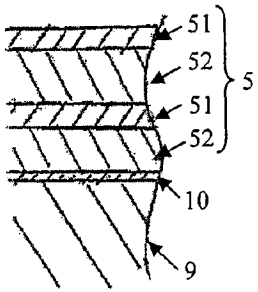
Figure 6D:
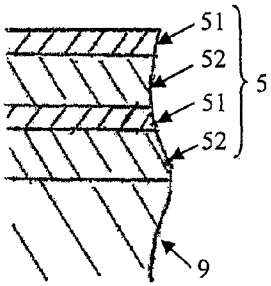

FIGS. 6A to 6D show a schematic sectional view of a sealing material of the present invention. In a sealing material 5 of the present invention, a porous metal layer has a two layer structure constituted of I of a surface layer portion 51 and II of a lower layer 52, wherein the porosity of I of the surface layer portion 51 is 60 to 65%, the porosity of II of the lower layer 52 is 67 to 75%. In FIG. 6A, the sealing material 5 is disposed on a base material 9 via an underlayer 10. In FIG. 6B, there is no undercoat layer 10 and a porous metal layer constituted of I: a surface layer portion 51 and II: a lower layer 52 is directly disposed on a base material 9. In FIG. 6C, a plurality of porous metal layers constituted of I: a surface layer portion 51 and II: a lower layer 52 is laminated and disposed on a base material 9 via an undercoat layer 10. In FIG. 6D, in a configuration of FIG. 6C, without an undercoat layer, a porous metal layer obtained by laminating a plurality of layers is directly disposed on a base material 9. In the sealing materials 5 of the present invention, FIGS. 6B and 6D can be used in a portion of which the temperature is relatively low, and, in FIGS. 6C and 6D, when used in a portion readily generating moisture owing to a decrease in a dew point of steam when a steam turbine stops, even when a porous metal layer (constituted of I of a surface layer portion 51 and II of a lower layer 52) of a surface portion of the present invention is damaged, a porous metal layer (constituted of I of a surface layer portion 51 and II of a lower layer 52) therebelow appears and is able to exert an advantage of the present invention. The number of repetition of lamination was taken as two for the description, but three or more can also provide the same advantage.

A porous metal layer I and a porous metal layer II are produced by a spray coating process, particularly preferably, by a plasma spraying process. A spraying raw material is preferably a powder containing a CoNiCrAlY alloy as a main component, hexagonal boron nitride (h-BN) that is a high temperature solid lubricant, and polyester, wherein it is preferable that h-BN is contained in the range of 3 to 7% by mass and the polyester is contained in the range of 15 to 25% by mass. In particular, relationship between an addition amount of the polyester that is a material for forming pores and the porosity of a coated film is important. A sprayed film is constituted of a CoNiCrAlY alloy, h-BN, and polyester. Among the components, the polyester sublimates and disappears when heated at 400 to 500° C. and thereby, in a sprayed film, the polyester portion becomes a vacant portion. Accordingly, porous metal layers different in porosity according to the present invention are produced by heating sprayed films different in polyester content with spraying powders different in polyester content. As an example, with a 9 MB gun (trade name, manufactured by Sulzer Metco Ltd.) and under the conditions of Ar—$H_2$ mixed gas, output power 40 kW and a spraying distance 125 mm, at 17% of polyester content to spraying powder, a sprayed film having a porosity of 60% was obtained; at 19%, a sprayed film having a porosity of 65%; and at 24%, a sprayed film having a porosity of 75% were also obtained.

Furthermore, as a means for forming films different in porosity in the present invention, there is also a method of controlling spraying conditions. With a 9 MB gun (trade name, manufactured by Sulzer Metco Ltd.) and under the conditions of Ar—$H_2$ mixed gas, output power: 45 kW and a spraying distance: 125 mm, at a polyester content of spraying powder of 17%, a sprayed film having a porosity of 55% was obtained; at 19%, a porosity of 60%; and at 24%, a porosity of 67%. What is described here is an example of a production method of the present invention, as a spraying method, either one of high velocity oxygen fuel (HVOF) spraying and air plasma spraying can be conducted, and the spraying conditions are also an example.

The hardness of the coated film was measured by the use of a Superficial Tester under a weight of 15 kg. In the hardness measurement, the hardness was measured at 7 points and an average value of 5 points excluding the minimum and maximum values was adopted. The porosity was obtained by image analysis from observation results of sectional structures of films with an optical microscope. In the image analysis, an area rate of a CoNiCrAlY alloy portion that was seen white was measured and an area rate of the other portion obtained by calculation was taken as the porosity. The porosity was measured after heat treatment in the range of 400 to 500° C. By heat treatment, polyester sublimates and disappears and forms voids in a film. Furthermore, h-BN in the film is not seen white with an optical microscope and is difficult to differentiate from voids; accordingly, it is treated as voids. In the porosity measurement, sectional structure observation was conducted at 3 points of the same test piece and an average value of measurements at the 3 points was adopted.

Figure 7:
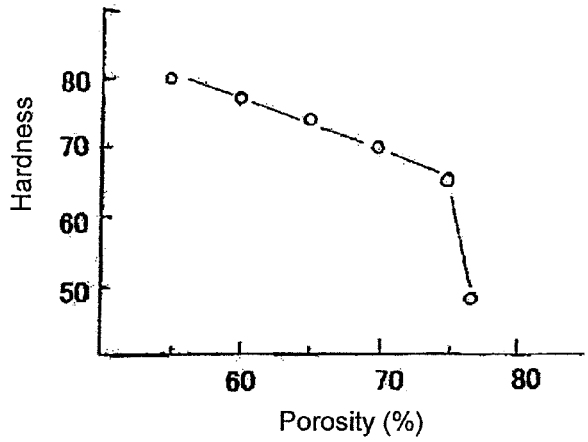
FIG. 7 shows relationship between porosities and hardness of prepared coating films.

FIG. 7 shows relationship between the porosities of the prepared coated films and hardness thereof. In the present invention, the porous metal layer I is differentiated from the porous metal layer II based on the porosity. However, as shown in FIG. 7, the porous metal layer I has the hardness of 77 to 74 and is differentiated from the porous metal layer II that has the hardness of 74 to 65.

The underlayer shown in FIG. 6 is not particularly restricted. However, as a component thereof, a heat-resistant metal such as an MCrAlY alloy, a Ni—Al alloy or a Ni—Cr alloy is preferred and a relatively dense coated film having the porosity of 5% or less is preferred. A base material is, for example, 12Cr steel used as a rotor material, airfoil material, and CrMoV steel for a casing material.

Examples and comparative examples of the present invention will be detailed below.

TABLE 2

Characteristics Comparison between the Present Invention's Examples and Comparative Examples (Surface layer portion: 0.3 mm, Lower layer: 1.7 mm)

| No | Surface layer portion Porosity (%) | Lower layer Porosity (%) | Abradable property | Steam resistance | Total evaluation | Remark |
|---|---|---|---|---|---|---|
| 1 | 55 | 60 | x | ○ | | Comparative examples |
| 2 | ↓ | 75 | x | ○ | | ↓ |
| 3 | 60 | 55 | x | ○ | | ↓ |
| 4 | ↓ | 60 | Δ | ○ | | ↓ |
| 5 | ↓ | 65 | Δ | ○ | | ↓ |
| 6 | ↓ | 67 | ○ | ○ | ◎ | Present invention |
| 7 | ↓ | 70 | ○ | ○ | ◎ | Present invention |
| 8 | ↓ | 75 | ○ | ○ | ◎ | Present invention |
| 9 | ↓ | 77 | x | ○ | | Comparative examples |
| 10 | 65 | 55 | x | ○ | | ↓ |
| 11 | ↓ | 60 | Δ | ○ | | ↓ |
| 12 | ↓ | 65 | Δ | ○ | | ↓ |
| 13 | ↓ | 67 | ○ | ○ | ◎ | Present invention |
| 14 | ↓ | 70 | ○ | ○ | ◎ | Present invention |
| 15 | ↓ | 75 | ○ | ○ | ◎ | Present invention |
| 16 | ↓ | 77 | x | ○ | | Comparative examples |
| 17 | 67 | 55 | x | x | | ↓ |
| 18 | ↓ | 60 | Δ | x | | ↓ |
| 19 | ↓ | 65 | Δ | x | | ↓ |
| 20 | ↓ | 67 | ○ | x | | ↓ |
| 21 | ↓ | 70 | ○ | x | | ↓ |
| 22 | ↓ | 75 | ○ | x | | ↓ |
| 23 | ↓ | 77 | x | x | | ↓ |

○: Excellent
○: Excellent
Δ: Partial sticking
x: Surface layer peeling
x: Sticking In Table 2, characteristics of sealing materials are shown by comparing Examples of the present invention and Comparative Examples thereof. It was found that, while Nos. 6 to 8 and 13 to 15 in Table 2 respectively show the sealing materials of Examples of the present invention and have excellent or almost excellent characteristics in both of the abradable property and steam resistance, Nos. 1 to 5 and 9 to 12, which are Comparative Examples, are rejected in either one of the abradable property or steam resistance, that is, do not reach characteristics adequate to use.

TABLE 3

Characteristics of the Present Invention

| | Surface layer portion | | Lower layer | | Abradable | Steam |
|---|---|---|---|---|---|---|
| No | Porosity (%) | Thickness (mm) | Porosity (%) | Thickness (mm) | property | resistance |
| 1 | 60 | 0.3 | 67 | 1.7 | ○ | ○ |
| 2 | 60 | 1 | 70 | 1 | ○ | ○ |

TABLE 3-continued

| Characteristics of the Present Invention | | | | | | |
|---|---|---|---|---|---|---|
| | Surface layer portion | | Lower layer | | Abradable | Steam |
| No | Porosity (%) | Thickness (mm) | Porosity (%) | Thickness (mm) | property | resistance |
| 3 | 60 | 0.3 | 75 | 1.7 | ○ | ○ |
| 4 | 60 | 0.6 | 75 | 2.4 | ○ | ○ |
| 5 | 60 | 0.1 | 75 | 0.2 | ○ | ○ |
| 6 | 65 | 0.3 | 67 | 1.7 | ○ | ○ |
| 7 | 65 | 0.3 | 70 | 1.7 | ○ | ○ |
| 8 | 65 | 0.3 | 75 | 1.7 | ○ | ○ |
| 9 | 65 | 0.1 | 75 | 0.2 | ○ | ○ |

Table 3 shows an example of Examples of the present invention. All Examples show good results of both characteristics of abradability and steam resistance. When a thickness of an entire porous metal layer of the present invention is 0.3 mm or less, the abradable property is not fully exerted, and, when the thickness is 3.0 mm or more, a gap is too large. Accordingly, a thickness of the entire porous metal layer is preferable to be in the range of 0.3 to 3.0 mm. Furthermore, as to thicknesses of the porous metal layer I and the porous metal layer II, a ratio of the porous metal layer I to the porous metal layer II (I/II) is preferably in the range of 0.1 to 1.0. This is because when the ratio is 0.1 or less, the steam resistance owing to the porous metal layer I decreases, and, when the ratio is 1.0 or more, the abradable property owing to the porous metal layer II is not sufficiently exerted.

Figure 8:
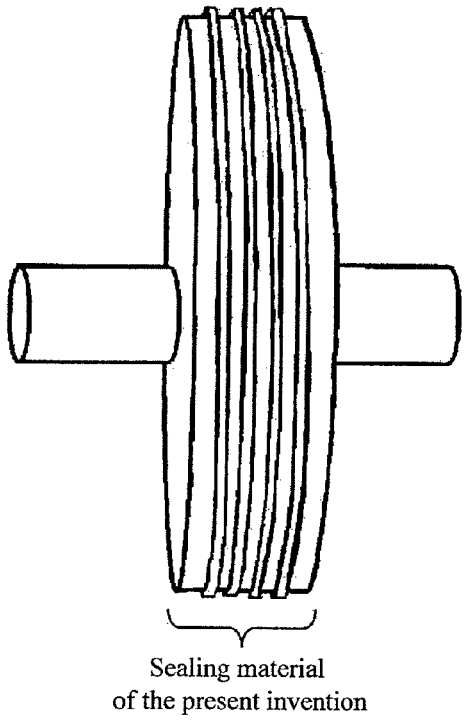
FIG. 8 shows an appearance of a seal portion of a simulated rotor to which a sealing material of No. 3 (Example 3) in Table 3 is disposed.

FIG. 8 shows an appearance of a seal portion of a simulated rotor to which a sealing material of No. 3 (Example 3) in Table 3 is disposed. FIG. 8 shows a constitution where a sealing material 5 of the present invention is disposed to a portion corresponding to a rotor 1 of FIG. 1A. A method for producing a sealing material was conducted in such a manner that a rotor was attached to a rotary jig and, with the rotor rotating at a predetermined rotation number, a spraying process was applied. By the use of the simulated rotor, combinations shown in schematic diagrams of FIGS. 1A and 1B were subjected to room temperature rotation tests. The rotation number was set at 4000 rpm. By disposing a sealing material, a gap can be made smaller (for example, from 0.8 mm to 0.26 mm) As the result thereof, a leakage amount from the gap could be reduced by about 30%. Furthermore, even in a test where the gap was made further smaller, any abnormality was not recognized during the test, also in the observation result after the test, a wear mark owing to fins was recognized on the sealing material, that is, it was confirmed to have an excellent abradable property.

Figure 9A:
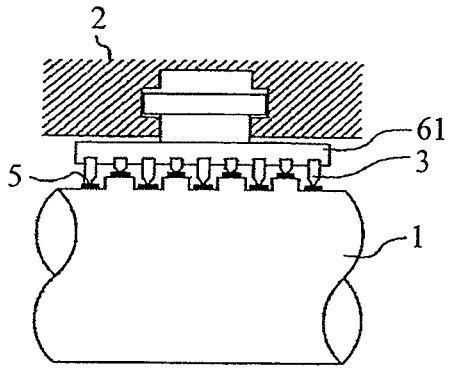
FIG. 9 illustrates a steam turbine rotor provided with a sealing material of No. 3 (Example 3) in Table 3 and a labyrinth sealing device.
Figure 9B:
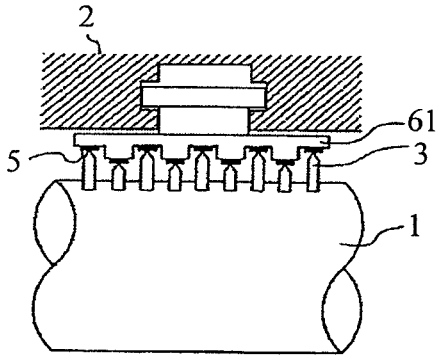

FIG. 9 illustrates appearances of a labyrinth sealing device 61 to which a sealing material 5 of No. 3 (Example 3) in Table 3 is provided and a rotor 1. In FIG. 9A, a sealing material 5 of the present invention was provided to the rotor 1, and, in FIG. 9B, a sealing material 5 of the present invention was provided to a seal stator 2. These sealing materials 5 of the present invention can reduce a gap in combination with an opposing fin 3 to the minimum of zero. When a sealing material of the present invention is provided in a gap between a stator and a rotor of a steam turbine, the gap can be made zero without limit over a long time, a fluid leaking from the gap can be made close to zero, which can greatly contribute to efficiency improvement over a long term.

Figure 10:
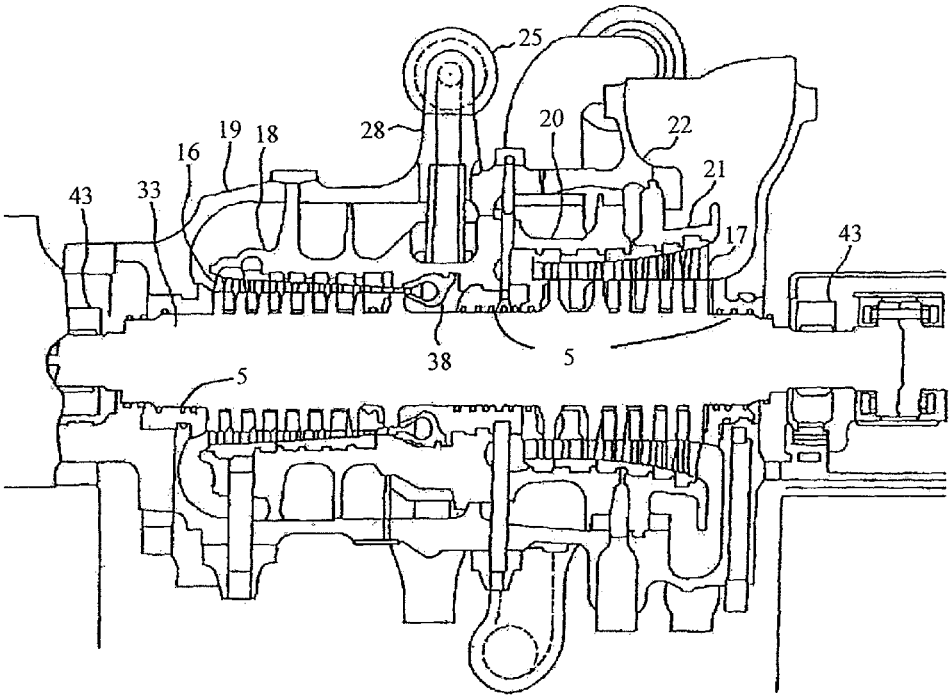
FIG. 10 shows a sectional view of an actual machine of an 800 MW class high to medium pressure rotor steam turbine to which a sealing material of No. 3 (Example 3) in Table 3 is disposed.

FIG. 10 shows an actual machine of an 800 MW high to medium pressure rotor steam turbine to which a sealing material of No. 3 (Example 3) in Table 3 is disposed. A method for producing a sealing material was conducted in such a manner that a rotor was attached to a rotary jig and with the rotor rotating at a predetermined rotation number a spraying process was applied. Other plasma spraying conditions are the same as that mentioned above. According to operation test results due to the actual machine, it was found that an improvement of about 1% in working efficiency of a steam turbine can be expected from the sealing material of the rotor.

What is claimed is:

1. A turbine metal sealing material used in a sealing device for reducing a fluid leaking from a gap between a stator and a rotor of a turbine, wherein the metal sealing material comprises a porous metal layer and the porous metal layer comprises a surface layer directly coming into contact with a working fluid and a lower layer lying thereunder, wherein the porosity of the surface layer is smaller than the porosity of the lower layer, wherein the porous metal layer comprises, as a main component, an MCrAlY alloy where M is either one of Ni and Co or both thereof, and the MCrAlY alloy comprises 15% to 30% of Cr, 6 to 15% of Al and 0.3 to 1.0% of Y, the balance comprising either one of Ni and Co or both thereof, and wherein a thickness of the porous metal layer is in the range of 0.3 to 3.0 mm, and a ratio of the surface layer to the lower layer is in the range of 0.1 to 1.0.

2. The turbine metal sealing material according to claim 1, wherein the porosity of the surface layer is 60 to 65% and the porosity of the lower layer is 67 to 75%.

3. The turbine metal sealing material according to claim 1, wherein the porous metal layer further comprises hexagonal boron nitride (h-BN).

4. A steam turbine comprising a sealing device for reducing a fluid leaking from a gap between a stator and a rotor of the turbine, a metal sealing material being used in the sealing device, wherein the metal sealing material comprises a porous metal layer and the porous metal layer comprises a surface layer directly coming into contact with a working fluid and a lower layer lying thereunder, wherein the porosity of the surface layer is smaller than the porosity of the lower layer, wherein the porous metal layer comprises, as a main component, an MCrAlY alloy where M is either one of Ni and Co or both thereof, and the MCrAlY alloy comprises 15% to 30% of Cr, 6 to 15% of Al and 0.3 to 1.0% of Y, the balance comprising either one of Ni and Co or both thereof, and wherein a thickness of the porous metal layer is in the range of 0.3 to 3.0 mm, and a ratio of the surface layer to the lower layer is in the range of 0.1 to 1.0.

* * * * *